United States Patent [19]

McLyman

[11] Patent Number: 4,975,672

[45] Date of Patent: Dec. 4, 1990

[54] HIGH POWER/HIGH FREQUENCY INDUCTOR

[75] Inventor: Colonel W.T. McLyman, Idylwild, Calif.

[73] Assignee: The United States of America as represented by the Administrator of the National Aeronautics and Space Administration, Washington, D.C.

[21] Appl. No.: 443,297

[22] Filed: Nov. 30, 1989

[51] Int. Cl.[5] ..... H01F 27/30

[52] U.S. Cl. ..... 336/198; 174/DIG. 8; 336/205; 336/229

[58] Field of Search ..... 174/DIG. 8; 336/196, 336/229, 205, 207, 206, 148, 149, 198

[56] References Cited

U.S. PATENT DOCUMENTS

| | | | |
|---|---|---|---|
| 1,514,006 | 11/1924 | Merwin | 336/149 |
| 2,511,230 | 6/1950 | Wald | 336/229 X |
| 2,937,351 | 5/1960 | Craig | 336/229 X |
| 3,025,452 | 3/1962 | Ross | 336/149 |
| 3,253,619 | 5/1966 | Cook et al. | 174/DIG. 8 |
| 3,290,758 | 12/1966 | Moyer | 336/200 X |
| 3,451,023 | 6/1969 | Aveyard et al. | 336/229 X |
| 3,576,387 | 3/1970 | Derby et al. | 174/DIG. 8 X |
| 4,276,102 | 6/1981 | Schaeffer et al. | 174/DIG. 8 X |
| 4,321,426 | 3/1982 | Schaeffer et al. | 174/DIG. 8 X |
| 4,639,707 | 1/1987 | Tanaka et al. | 336/229 X |
| 4,724,603 | 2/1988 | Blanpain | 336/229 X |

FOREIGN PATENT DOCUMENTS

| | | | |
|---|---|---|---|
| 432171 | 7/1926 | Fed. Rep. of Germany | 336/149 |
| 607048 | 6/1935 | Fed. Rep. of Germany | 336/229 |
| 2108343 | 9/1978 | Fed. Rep. of Germany | 174/DIG. 8 |

*Primary Examiner*—Thomas J. Kozma

*Attorney, Agent, or Firm*—Thomas H. Jones; John R. Manning

[57] ABSTRACT

A toroidal core is mounted on an alignment disc having uniformly distributed circumferential notches or holes therein. Wire is then wound about the toroidal core in a uniform pattern defined by the notches or holes. Prior to winding, the wire may be placed within shrink tubing. The shrink tubing is then wound about the alignment disc and core and then heat-shrunk to positively retain the wire in the uniform position on the toroidal core.

9 Claims, 2 Drawing Sheets

HIGH POWER/HIGH FREQUENCY INDUCTOR

ORIGIN OF THE INVENTION

The invention described herein was made in the performance of work under a NASA contract, and is subject to the provisions of Public Law 96-517 (35 USC 202) in which the Contractor has elected not to retain title.

TECHNICAL FIELD

The subject invention pertains to electrical components and, more particularly, to an improved inductor design, which exhibits increased repeatability in manufacture of both low and high power, high frequency inductors.

BACKGROUND ART

The present trend in power conversion is to go higher and higher in frequency. Frequencies, such as 0.25–2.0 MegaHertz and higher, have been made possible because of new components which are now available, such as power MOSFETS, better ferrite materials, and quality film capacitors. One of the design approaches in this high frequency field is the resonant converter. The design of a resonant converter requires a high frequency inductor.

In the past, such inductors have been typically fabricated by hand winding Litz wire on a toroidal core. Litz wire is finer than human hair and has no strength. Such prior art high frequency inductor designs result in large amounts of leakage flux, the order of which could be as much as 1.5 to 2.0 times greater than the desired inductance. This variation in leakage flux seriously interferes with production of repeatable designs

STATEMENT OF THE INVENTION

Accordingly, it is an object of the invention to improve inductor structures and performance;

It is another object of the invention to provide an inductor structure which exhibits improved repeatability; and It is another object of the invention to provide improved high frequency, high power inductor structures.

According to the invention, alignment discs are provided which assist in accurate alignment of fine conductor wire during fabrication of the inductor. The alignment discs employ notches, serrations, or holes to guide the coil wire in uniform fashion about a toroidal core mounted on the disc. The uniform distribution of the coil wire yields a repeatable leakage factor, which, in turn, permits a repeatable inductor design.

An additional feature according to the invention is the provision of shrink tubing through which the fine wire is first pulled. The shrink tubing and wire are thereafter wrapped around a toroidal core in a uniform fashion with the assistance of an alignment disc. Finally, the shrink tubing is heated to rigidly retain the fine wire in precise, uniformly distributed position.

BRIEF DESCRIPTION OF THE DRAWINGS

The just-summarized invention will now be described in detail in conjunction with the drawings, of which.

DETAILED DESCRIPTION OF THE INVENTION

Figure 1:
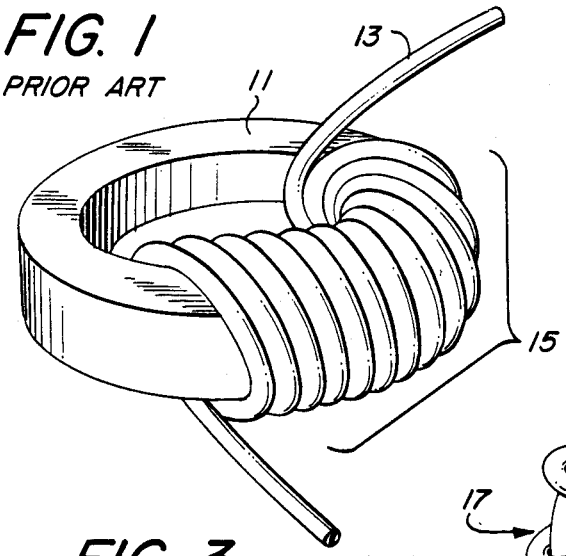
FIG. 1 PRIOR ART
FIG. 1 illustrates a prior art inductor design.

A typical prior art toroidal power core 11 is shown in FIG. 1. This core 11 is wound with a number of turns 15 of Litz wire 13. As is well-known to those skilled in the art, Litz wire is fine and fragile wire typically used to wind high power, high frequency inductors. In the typical prior art high frequency, high power design, the number of turns 15 is relatively few, for example, 20 or so turns. These turns 15 are wound adjacent one another on one segment of the toroidal core 11 as shown. The toroidal core 11 typically varies from between 0.125 to 6.0 inches in outside diameter. The core 11 exhibits extremely low permeability, on the order of e.g., 4. Typical core materials are powdered iron or powdered moly permalloy. The prior art design shown in FIG. 1 exhibits large amounts of leakage or fringing flux, for example, one to two times greater than the desired inductance.

According to the preferred embodiment, the inductor winding is fabricated in a controlled, uniformly distributed manner, in order to obtain repeatability of the electrical parameters. The approach of the preferred embodiment thus avoids the closely packed winding approach of FIG. 1, while being applicable to various diameter cores.

Figure 2:
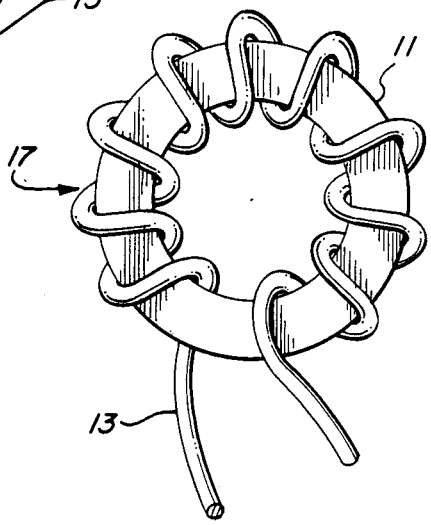
FIG. 2 is a side top view of a uniformly wound inductor.

A winding 17 according to the preferred embodiment is illustrated in FIG. 2. In this embodiment, the relatively few turns of Litz wire 13 are disposed uniformly around the entire 360-degree circumference of the toroidal core 11.

Figure 3:
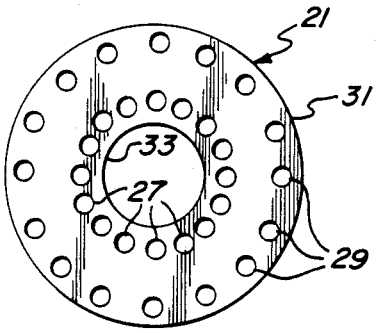
FIGS. 3 to 5 illustrate alignment discs according to the preferred embodiment.
Figure 4:
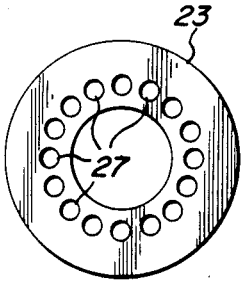
Figure 5:
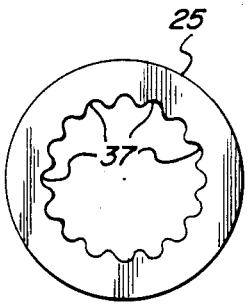

In order to repeatably wind an actual core 11 in the uniform fashion illustrated in FIG. 2, alignment discs 21, 23, 25 as illustrated in FIGS. 3–5 are employed. The embodiment of FIG. 3 employs inner and outer sets of alignment holes 27, 29 in an otherwise annular disc 21. Both sets of alignment holes 27, 29 are uniformly spaced about the respective inner and outer circumferences 31, 33 of the disc 21. The centers of the inner set of holes 27 are at a common distance from the center of the annular disc, as are the centers of the outer set of holes 29. In use, a toroidal core 11 is placed between the sets of holes 27, 29 and the Litz wire is then wrapped about the core and through the holes 27, 29. The core 11 may be glued to the disc 21 for additional stability.

The alternative alignment disc 23 shown in FIG. 4 employs only the inner set of circumferentially spaced alignment holes 27, while the embodiment of FIG. 5 employs notches or serrations 37 instead of holes in an otherwise annular disc 25. The notches or serrations 37 are again equally spaced apart about the inner circumference of the disk 25 at a uniform distance from the center of the disc 25. Notches 37 can be placed on either the inner or outer circumference of the disk 25, or both. All these discs 21, 23, 25 are reliable and easily manufactured, for example, from plastic or fiberglass.

Figure 6:
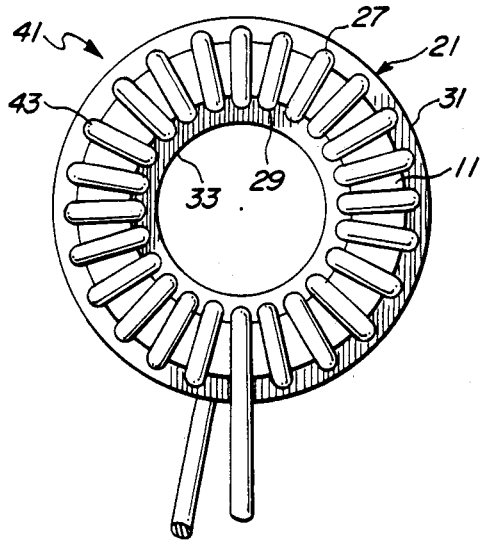
FIG. 6 is a top view of an inductor according to the preferred embodiment.
Figure 7:
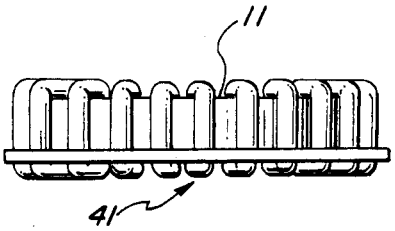
FIG. 7 is a side view of the embodiment of FIG. 7.

FIGS. 6 and 7 show a completely wound toroidal inductor 41 employing a toroidal core 11 mounted on an alignment disc 21. Litz wire 43 is wound through the holes 27, 29 so as to be uniformly distributed about the toroidal core 11. Such a design is typically dipped in a coating such as a urethane polymer or semirigid epoxy to positively hold the wire 43 in place, while at the same time providing environmental protection.

Figure 8:
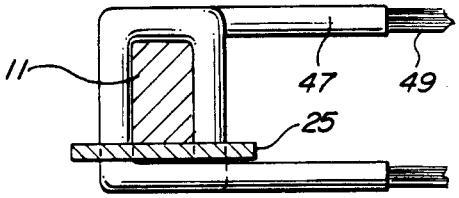
FIG. 8 is a side sectional view illustrating an alternate embodiment.

FIG. 8 illustrates a further improved embodiment wherein shrink tubing 47 is wound about a core 11 with the assistance of an alignment disc 25. While any of various disc designs 21, 23, 25 could be used, it is presently felt that the disc 25 of FIG. 5 is the most appropriate for the design of FIG. 8. Prior to wrapping the shrink tubing 47 about the core 11 and the disc 25 in a uniformly distributed manner, the Litz wire 49 is pulled through the shrink tubing 47. Hence, after winding, both the shrink tubing 47 and the interiorly contained Litz wire 49 are uniformly spaced around the disc 25 and the core 11. The shrink tubing 47 is then heated with a heat gun, which causes it to shrink up and freeze rigidly around the toroidal core 11 and disc 25, thus securing the Litz wire 49 in a uniform pattern around the core 11, such as that illustrated in FIG. 2.

Figure 9:
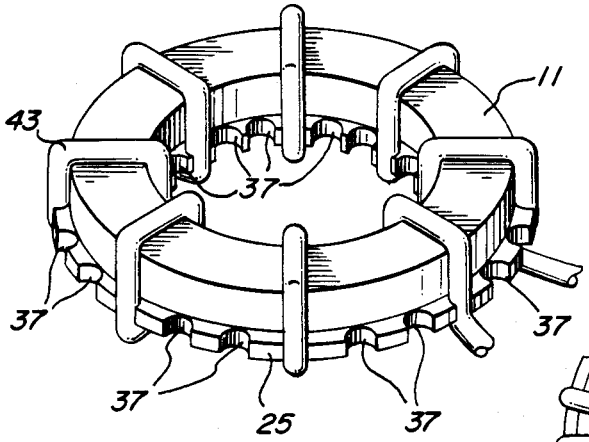
FIG. 9 is a perspective view of an alternate embodiment of the invention.

It may be appreciated that not every hole 27, 29 in the alignment disc 21 need be used. For example, the Litz wire 43 could be wound through every other hole, with the holes color coded to indicate the appropriate holes through which to insert the wire 43. FIG. 9 shows an exemplary embodiment wherein the wire 43 is retained by every third notch 37 of a disc 25.

Figure 10:
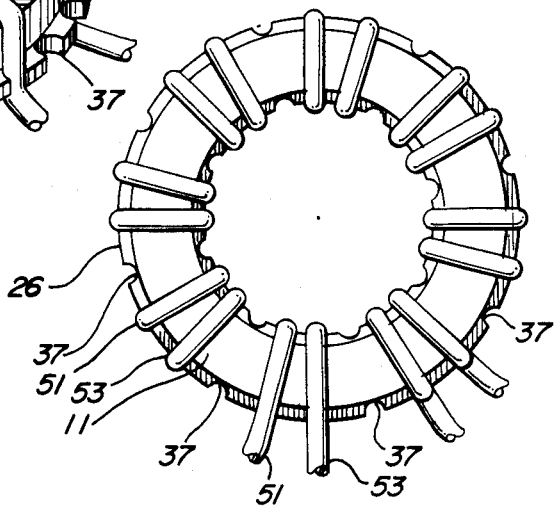
FIG. 10 is a top view illustrating a transformer fabricated according to an alternate embodiment.

FIG. 10 shows an embodiment wherein two wires 51, 53 are wound adjacent one another about an alignment disc 26 and a toroidal core 11. As shown, one notch 37 is skipped between pairs of notches 37 which are occupied by respective turns of the wires 51, 53. The resulting structure functions as a transformer of precise, repeatable design.

While the above disclosure has employed the use of Litz wire, a strand of fine enameled wire could also be used. Such enameled wire can be glazed, for example, with an epoxy film for rigidity.

A significant advantage of the foregoing design is that the amount of leakage flux can be precisely and repeatedly controlled so that accurate inductor values can be reliably and repeatedly determined in the design process. For example, if one wants an inductor of value X and knows the leakage flux will be Y, then the number of turns and other parameters of design can be computed to provide a nominal value of X-Y. An additional advantage attendant to the ability to accurately design the inductor is that padding capacitor values do not have to be extremely large.

In summary, a high-power, high-frequency AC (alternating current) inductor has been disclosed which accommodates the undesirable effect of fringing flux. The winding of the inductor is fabricated in a manner so as to acquire repeatability of the electrical parameters with inside core diameters ranging from 0.125 to 6.0 inches, thereby controlling the inductance in a simple, reliable, and easily repeatable manner.

Those skilled in the art will appreciate that various modifications and adaptations may be made in the just-disclosed embodiments without departing from the scope and spirit of the invention. Therefore, it is to be understood that, within the scope of the appended claims, the invention may be practiced other than as specifically described herein.

I claim:

1. A high frequency AC inductor formed of turns of a single continuous Litz wire strand and comprising:

an alignment disc, said disc comprising the only alignment disc associated with said inductor;

a toroidal, magnetic core mounted on said alignment disc;

means in said alignment disc for distributing said turns of Litz wire about the entire toroidal surface of said toroidal core with uniform spacing between the turns of said wire and shrink tubing surrounding said Litz wire, said tubing having been shrunk to positively retain said wire in said uniform spacing about said cove.

2. The inductor of claim 1 wherein said alignment disc comprises a flat annular ring having first and second circumferences within which said toroidal core is disposed, and wherein said means comprises a first plurality of holes positioned around a first circumference of said annular ring.

3. The inductor of claim 2 wherein said first circumference comprises the outer circumference of said ring and said means further includes a second plurality of holes positioned around the inner circumference of said annular ring.

4. The inductor of claim 3 wherein said first plurality of holes comprises a first set of holes uniformly spaced about said outer circumference, each hole of said first set having a center equidistant from the center of said annular ring; and wherein said second plurality of holes comprises a second set of holes uniformly spaced about said inner circumference, each hole of said second set having a center equidistant from the center of said annular ring.

5. The inductor of claim 1 wherein said alignment disc comprises a flat, substantially annular ring and said means comprises notches formed in said ring.

6. The inductor of claim 5 wherein said notches comprise a first set of notches uniformly spaced about a first circumference of said ring.

7. The inductor of claim 5 wherein said first circumference comprises the outer circumference of said ring and wherein said notches comprise a second set of notches uniformly spaced about the inner circumference of said ring.

8. The inductor of claim 7 wherein said notches comprise a first set of notches uniformly spaced about the first circumference of said ring.

9. The inductor of claim 2 wherein said wire is wound about said core and through a first set of said first holes and wherein said wire is not wound through a second set of said first holes, said second set of holes being distributed in a uniform manner about said first circumference.

* * * * *